US009545811B2

(12) United States Patent
Talbot et al.

(10) Patent No.: US 9,545,811 B2
(45) Date of Patent: Jan. 17, 2017

(54) GREETING CARDS WITH MULTI-PANEL INSERT

(71) Applicant: American Greetings Corporation, Cleveland, OH (US)

(72) Inventors: John Talbot, Bay Village, OH (US); Sean Higgins, Cleveland, OH (US); Melissa Flesher, Avon, OH (US); Erin Dennis, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/953,105

(22) Filed: Nov. 27, 2015

(65) Prior Publication Data

US 2016/0159135 A1 Jun. 9, 2016

Related U.S. Application Data

(60) Provisional application No. 62/087,485, filed on Dec. 4, 2014.

(51) Int. Cl.
*B42D 15/02* (2006.01)
*B42D 15/04* (2006.01)

(52) U.S. Cl.
CPC ..... *B42D 15/022* (2013.01); *B42D 15/042* (2013.01)

(58) Field of Classification Search
CPC .... B42D 15/022; B42D 15/042; B42D 15/045
See application file for complete search history.

(56) References Cited

U.S. PATENT DOCUMENTS

| | | | | |
|---|---|---|---|---|
| 849,426 | A * | 4/1907 | Reiman | G09F 7/00 229/92.8 |
| 922,715 | A * | 5/1909 | Munster | G09F 1/00 229/92.8 |
| 1,148,520 | A | 8/1915 | Mann | |
| 2,425,789 | A | 2/1946 | Fisler | |
| 4,104,809 | A * | 8/1978 | Day | G09F 5/04 281/15.1 |
| 5,387,084 | A * | 2/1995 | Walberg | A45B 27/00 416/142 |

(Continued)

FOREIGN PATENT DOCUMENTS

CN WO2013153885 10/2013

*Primary Examiner* — Gary Hoge
(74) *Attorney, Agent, or Firm* — Christine Flanagan

(57) ABSTRACT

An interactive greeting card with a multi-panel insert which can be unfurled over a portion of the greeting card. In one embodiment, there is a photo or drawing of a character or animal printed on the front cover. A tab is located to the left of and behind the photo or drawing. When a user grasps and moves the tab, a multi-panel paper construct unfurls around the photo or drawing and appears as a wig atop the head of the character or animal depicted in the photo or drawing. Audio replay may also triggered by moving the tab from its original position. In another embodiment, the panels of the multi-panel paper construct are each shaped like a different item or object which is complementary to the theme of the greeting card. Unfolding the multi-panel construct along an outside edge of the greeting card may initiate audio playback and may also activate a motor module which causes movement to at least one mobile object contained on the greeting card.

20 Claims, 10 Drawing Sheets

(56) References Cited

U.S. PATENT DOCUMENTS

| | | | | |
|---|---|---|---|---|
| 5,871,237 | A * | 2/1999 | Hunt | A63H 33/38 281/15.1 |
| 5,980,205 | A | 11/1999 | Sue | |
| 6,061,938 | A * | 5/2000 | Young | G09F 11/00 116/321 |
| 6,393,743 | B1 * | 5/2002 | Whitworth | B42D 15/042 283/50 |
| 6,643,961 | B1 * | 11/2003 | Hluchan | G09F 1/04 40/492 |
| 7,415,789 | B2 * | 8/2008 | Hluchan | G09F 1/04 116/322 |
| D591,622 | S | 5/2009 | Cakert | |
| 7,552,553 | B2 * | 6/2009 | Kelly | B42D 15/045 40/124.08 |
| 7,707,757 | B2 * | 5/2010 | Crowell | G09F 11/30 40/490 |
| 2006/0093976 | A1 * | 5/2006 | Roccograndi | F23Q 25/00 431/145 |
| 2007/0109508 | A1 | 5/2007 | Winter et al. | |
| 2009/0014997 | A1 * | 1/2009 | Clegg | B42D 15/045 281/45 |
| 2011/0078931 | A1 * | 4/2011 | Sapp | B42D 15/022 40/124.03 |
| 2011/0146117 | A1 * | 6/2011 | Mayer | B42D 15/022 40/124.03 |
| 2013/0139418 | A1 * | 6/2013 | Bogdanski | B42D 15/022 40/124.03 |
| 2014/0144053 | A1 * | 5/2014 | Sunoo | B42D 15/04 40/124.09 |
| 2014/0360064 | A1 * | 12/2014 | Mayer | B42D 15/022 40/124.03 |

* cited by examiner

GREETING CARDS WITH MULTI-PANEL INSERT

RELATED APPLICATIONS

This application is a non-provisional of and claims priority to U.S. Provisional Patent Application No. 62/087,485, filed on Dec. 4, 2014, a copy of which is incorporated herein by reference in its entirety.

FIELD OF THE INVENTION

This invention is in the field of greeting cards and social expression products. More specifically, this invention is directed to an interactive audio greeting card.

SUMMARY OF THE INVENTION

An interactive greeting card with a multi-panel insert which can be unfurled over a portion of the greeting card. In one embodiment, there is a photo or drawing of a character or animal printed on the front cover. A tab is located to the left of and behind the photo or drawing. When a user grasps and moves the tab, a multi-panel paper construct unfurls around the photo or drawing and appears as a wig atop the head of the character or animal depicted in the photo or drawing. Audio replay may also triggered by moving the tab from its original position. In another embodiment, the panels of the multi-panel paper construct are each shaped like a different item or object which is complementary to the theme of the greeting card. Unfolding the multi-panel construct along an outside edge of the greeting card may initiate audio playback and may also activate a motor module which causes movement to at least one mobile object contained on the greeting card.

DETAILED DESCRIPTION OF PREFERRED AND ALTERNATE EMBODIMENTS

The greeting card of the present invention combines a traditional greeting card with a tab which unfurls a multi-panel insert or fan-like pull out structure over a portion of the greeting card. The tab may also work in combination with a switch which initiates a sound module operative to store and playback at least one audio file.

In a first embodiment, shown in FIGS. 1 through 5, the greeting card includes three greeting card panels. Each greeting card panel has an inside surface and an outside surface opposite the inside surface. A first panel P1 is attached to a second panel P2 along a first fold F1 line and a third panel P3 is attached to the second panel P2 along a second fold line F2. The third panel P3 is folded over the inside surface of the second panel P2 (such that the inside surface of the third panel P3 faces the inside surface of the second panel P2) along the second fold line F2 and is attached along all free edges, creating a pocket or cavity therebetween. The first panel P1 is folded backwards over the second panel P2 along the first fold line F1 such that the outside surface of the first panel P1 faces the outside surface of the second panel P2. The outside surface of the third panel P3 serves as the front cover of the greeting card 100. The outside surface of the second panel P2 serves as the inside left panel of the greeting card 100. The outside surface of the first panel P1 serves as the inside right panel of the greeting card 100 and the inside surface of the first panel P1 serves as the back cover of the greeting card 100. The greeting card 100 opens and closes by pivoting the cover panel (P3 and P2) away from the back panel (P1) along the first fold line F1. The greeting card panels P1, P2, P3 are preferably of the same or similar shapes and sizes and may contain straight or linear edges but may alternatively have different shapes or sizes and contain non-linear edges. While the greeting card is described herein and shown in the figures to have three greeting card panels, it is considered to be within the scope of the invention to have two panels, four panels, or greater than four panels.

Figure 1:
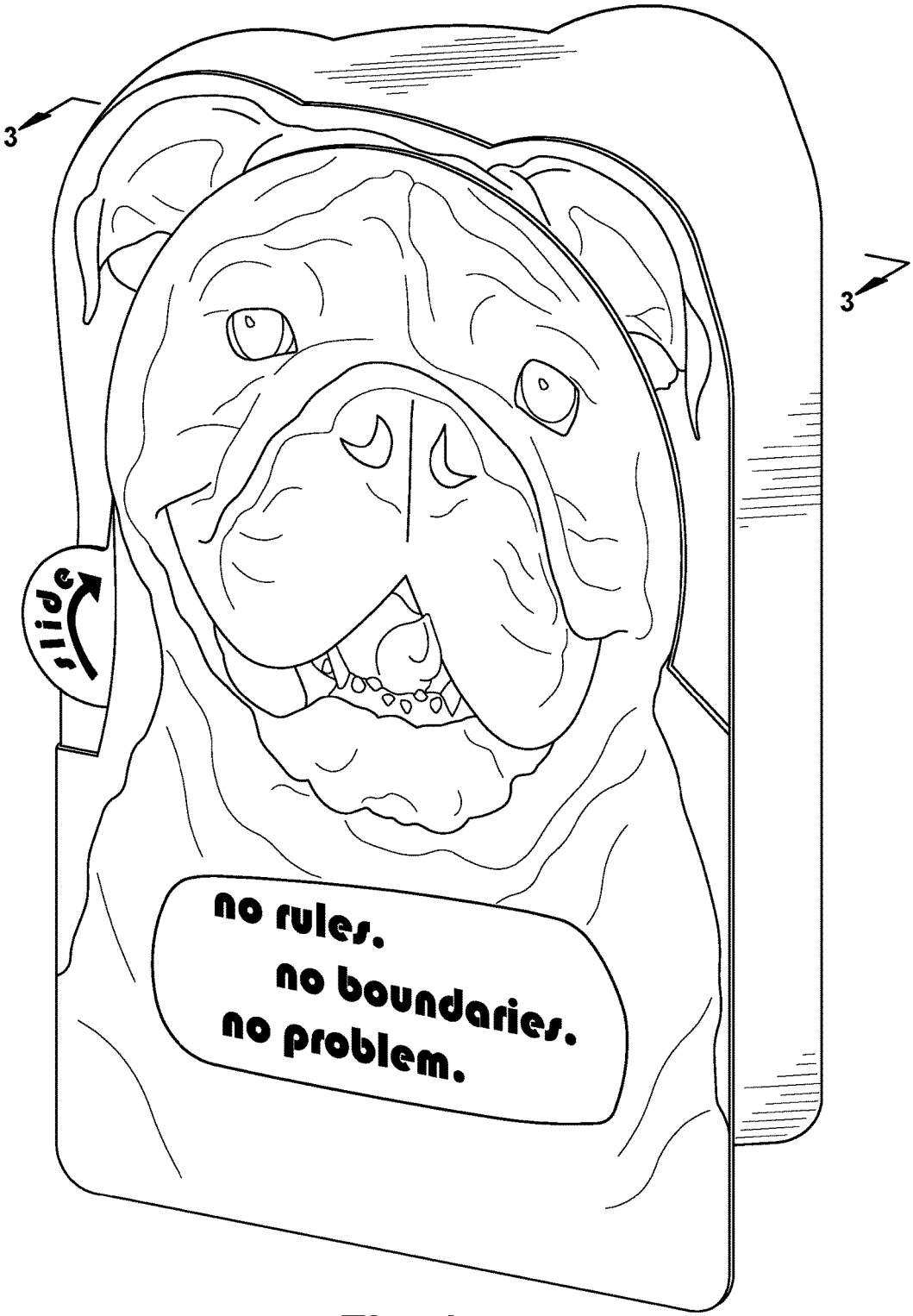
FIG. 1 is a perspective view of a first embodiment of the greeting card of the present invention.
Figure 2:
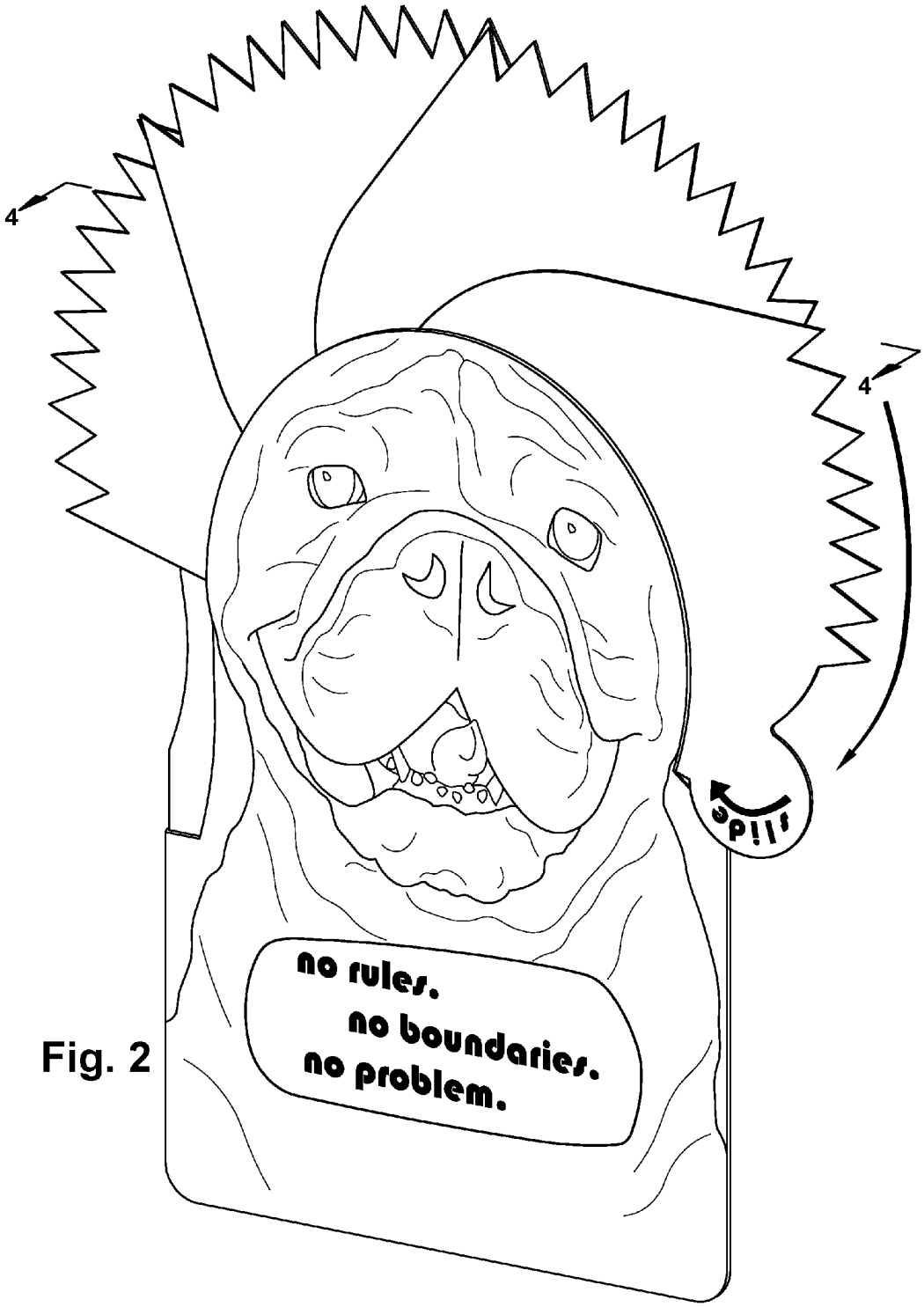
FIG. 2 is a perspective view of the greeting card of FIG. 1, with open pull out structure.
Figure 3:
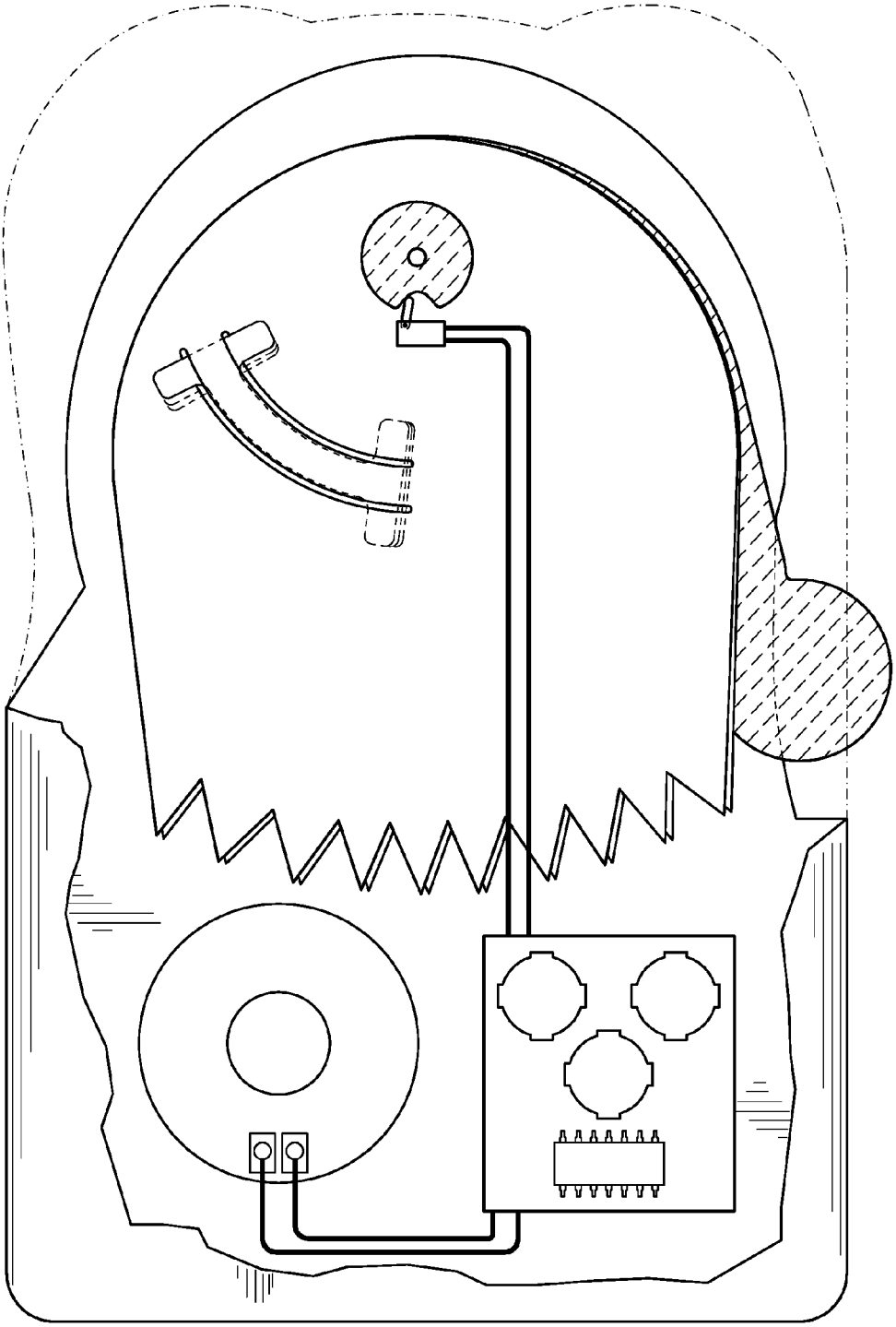
FIG. 3 is a front tear-away view of the greeting card of FIG. 1, from the perspective of arrows 3-3.
Figure 4:
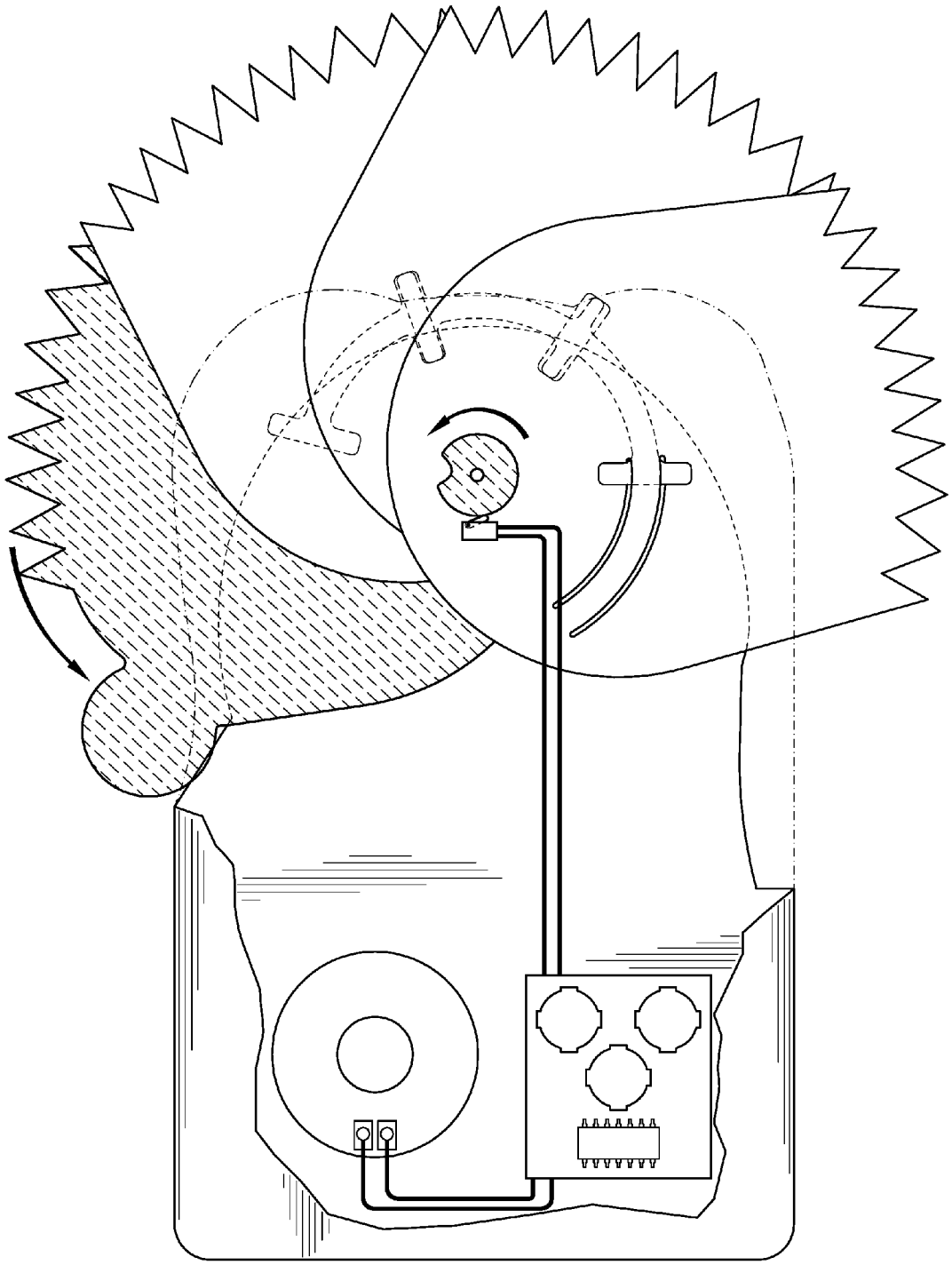
FIG. 4 is a front tear-away view of the greeting card of FIG. 2, from the perspective of arrows 4-4.
Figure 5:
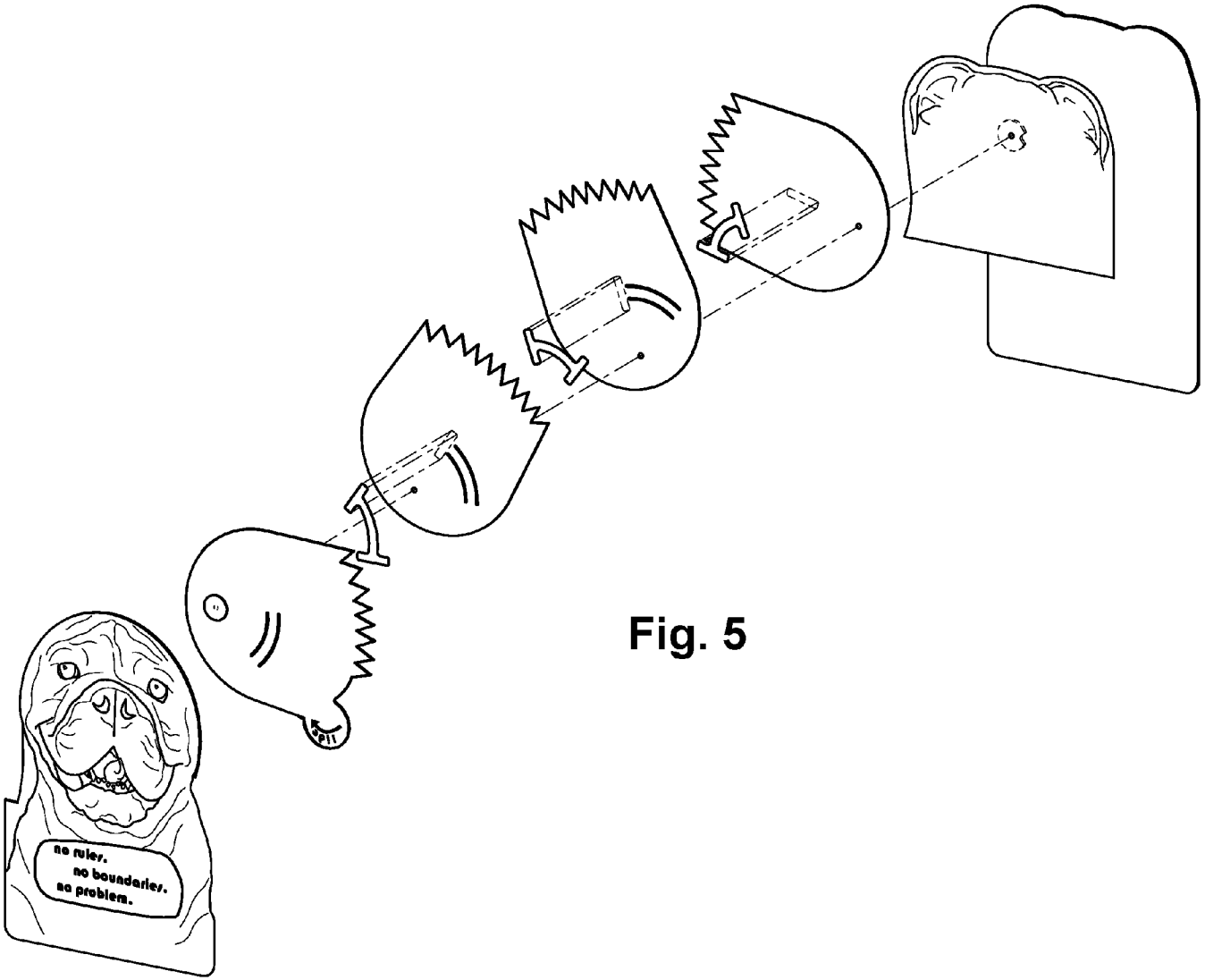
FIG. 5 is an exploded view of the greeting card of FIG. 1.

A multi-panel insert MPI includes a plurality of individual, similarly shaped panels which are positioned in a stacked arrangement within the pocket or cavity between second P2 and third P3 greeting card panels. The cover panel (P3) contains wide slot or opening 12 near an upper portion thereof to facilitate insertion of the multi-panel insert MPI such that the multi-panel insert MPI can move from a first position wherein the multi-panel insert MPI is substantially contained within the pocket created between the second P2 and third P3 greeting card panels (as shown in FIGS. 1 and 3) and a second position wherein the multi-panel insert MPI is unstacked, fanned-out and contained substantially outside of the pocket created between the second P2 and third P3 greeting card panels (as shown in FIGS. 2 and 4). Each of the plurality of panels MPI1, MPI2, MPI3, MP14 in the multi-panel insert MPI is attached to a post 14 about which the panels MPI1, MPI2, MPI3, MPI4 pivot. Each panel MPI1, MPI2, MPI3, MPI4 also contains at least two arced slots or openings 16A, 16B thereon for engagement with a stopper mechanism 18. Each stopper mechanism 18 is curved or arced and contain two t-shaped prongs at each opposing end. The two arced slots 16A, 16B and stopper mechanisms 18 work together to enable the paper fan or wig (aka the multi-panel insert MPI) to move from the first position (substantially contained within the greeting card) to the second position (substantially contained outside of the greeting card). With the exception of the bottom panel in the stack MPI4, each of the other multi-panel insert panels MPI1, MPI2, MPI3 have a stopper mechanism 18 attached thereto. Each stopper mechanism 18 is attached at one end to one of the multi-panel insert panels while the opposite end gets inserted into the two arched slots or openings 16A, 16B contained on the adjacent panel located directly above or on top thereof. For example, the first multi-panel insert panel MPI1 (located at the top of the stack) has one end of a first stopper mechanism 18 attached thereto (via glue or other attachment mechanism) while the opposite end of said first stopper mechanism 18 is inserted into the arced slots 16A, 16B on the second multi-insert panel MPI2 (located second from the top of the stack). Similarly, the second multi-panel insert panel MPI2 has a second stopper mechanism 18 attached thereto while the opposite end of said second stopper mechanism 18 is inserted into the arced slots 16A, 16B located on the third multi-panel insert MPI3 and the third multi-panel insert MPI3 contains a third stopper mechanism 18 attached thereto while the opposite end of said third stopper mechanism 18 is inserted into the arced slots 16A, 16B located on the fourth multi-panel insert panel MPI4. The fourth multi-panel insert panel MPI4 does not have a stopper attached directly thereto because it is the last panel in the stack and it does not have to interact with another panel therebeneath. Each stopper mechanism 18 and arced slot pair 16A, 16B are attached to each successive panel in the stack at a strategic location along an arced path which allows each panel to move independently for certain distance (the length of the arced path contained on the panel above it in the stack) before pulling the next or successive panel in the stack along. The length of the two arched slots 16A, 16B define the independent range of motion for each panel MPI1, MPI2, MPI3, MPI4 as it is unfolded or unfurled over the top of the greeting card 100. A small pull tab mechanism 20 is integral with or attached to the upper most panel in the multi-panel insert MPI stack. The pull tab mechanism 20 peeks out from the opening 12 in the greeting card cover panel P3. It may contain printing thereon instructing the user to "slide" or "pull" to unfurl the paper wig MPI. A user may use the pull tab 20, such as by grasping the pull tab 20 between a thumb and index finger and sliding the tab 20 around the top of the greeting card 100 in an arced path which corresponds to the top surface of the head of the character or animal (dog as shown in the figures) printed on the greeting card 100. The tab 20 is positioned on the left side of the greeting card 100 and when pulled from the left side of the greeting card 100 (first position, shown in FIG. 1) to the opposing position on the right side of the greeting card 100, the paper wig MPI is unfurled (second position, shown in FIG. 2). Moving the tab 20 from the right side of the greeting card 100 back to the left side of the greeting card (original position) folds the paper wig MPI back into the cavity inside the greeting card 100. Each of the panels MPI1, MPI2, MPI3, MPI4 of the multi-panel insert MPI are similarly shaped and printed or decorated to represent a type of hair style or look. For example, as shown in the figures, each panel MPI1, MPI2, MPI3, MPI4 contains top edges which are jagged or zig-zagged to represent a spiked hair style. Each panel MPI1, MPI2, MPI3, MPI4 may also have printing thereon which represents a color or type of hair. When the tab 20 is moved from the first position within the greeting card to the second unfolded position, the combination of panels MPI1, MPI2, MPI3, MPI4 in the multi-panel insert MPI are unfolded in an arched arrangement around a picture of a character or animal on the front panel P3 of the greeting card 100, such as the dog shown in FIGS. 1 and 2. Unfurling the multi-panel insert MPI by pulling the tab 20 around the top of the greeting card 100 presents the face of a dog with spiked hair. The panels MPI1, MPI2, MPI3, MPI4 of the multi-panel insert MPI may be shaped, printed and decorated to resemble any type of hair style, such as a multi-colored clown wig, a Mohawk, or any other hair style. Similarly, the front cover P3 of the greeting card 100 may be printed with any type of person, animal, cartoon character, historical figure or the like. While the multi-panel insert has been described herein and shown in the figures as having four panels, it may alternatively have two, three, five, six, or greater than four panels. With each additional panel added, an additional stopper mechanism 18 would also need to be added. A variation in the number of panels, slots, and stopper mechanisms is considered to fall under the scope of the present invention.

The pull tab mechanism 20 also works in combination with a switch 28 to initiate audio playback. A sound module may contain within the cavity within the greeting card 100 and may include any and all components necessary to store and produce or emit sound. Some of the internal electronic components may include, but are not limited to: a circuit board 22; an integrated circuit chip; a power source 24; a speaker 26; a switch 28, a memory device and at least one pre-recorded digital audio clip. The electronic components of the greeting cards described herein are considered to be readily understood and appreciated by one of ordinary skill in the art and are therefore not discussed in detail herein. In addition to audio capabilities, the greeting may contain additional electronic features such as one or more lights and a motor for effecting movement of a portion of the greeting card.

In a second, alternate embodiment of the present invention, the greeting card 200 contains a tab 30 which can be used by a user to unfurl a multi-panel insert or fan-like construct (with audio trigger capabilities), similar to the first embodiment described directly above, but this embodiment adds motor movement capabilities. This embodiment is shown in FIGS. 6 through 10. The greeting card 200 includes a first panel P1 which serves as the front cover of the greeting card 200. The first panel P1 is attached to a second panel P2 along all outer edges to form a cavity therebetween. The greeting card electronics are contained and concealed within this cavity. The first panel P1 serves as the front cover of the greeting card 200 and the second panel serves P2 as the inside left panel of the greeting card 100. A third panel P3 is attached to the first P1 or second P2 panel along a fold line F. The inside surface of the second panel P2 serves as the inside right panel of the greeting card 200 and the outer surface of the second panel P2 serves as the outer or rear cover of the greeting card 200. Each surface of the greeting card panels P1, P2, P3 may be printed with photos, pictures, drawings or other printed indicia. Other embellishments may be attached thereto as well.

Figure 6:
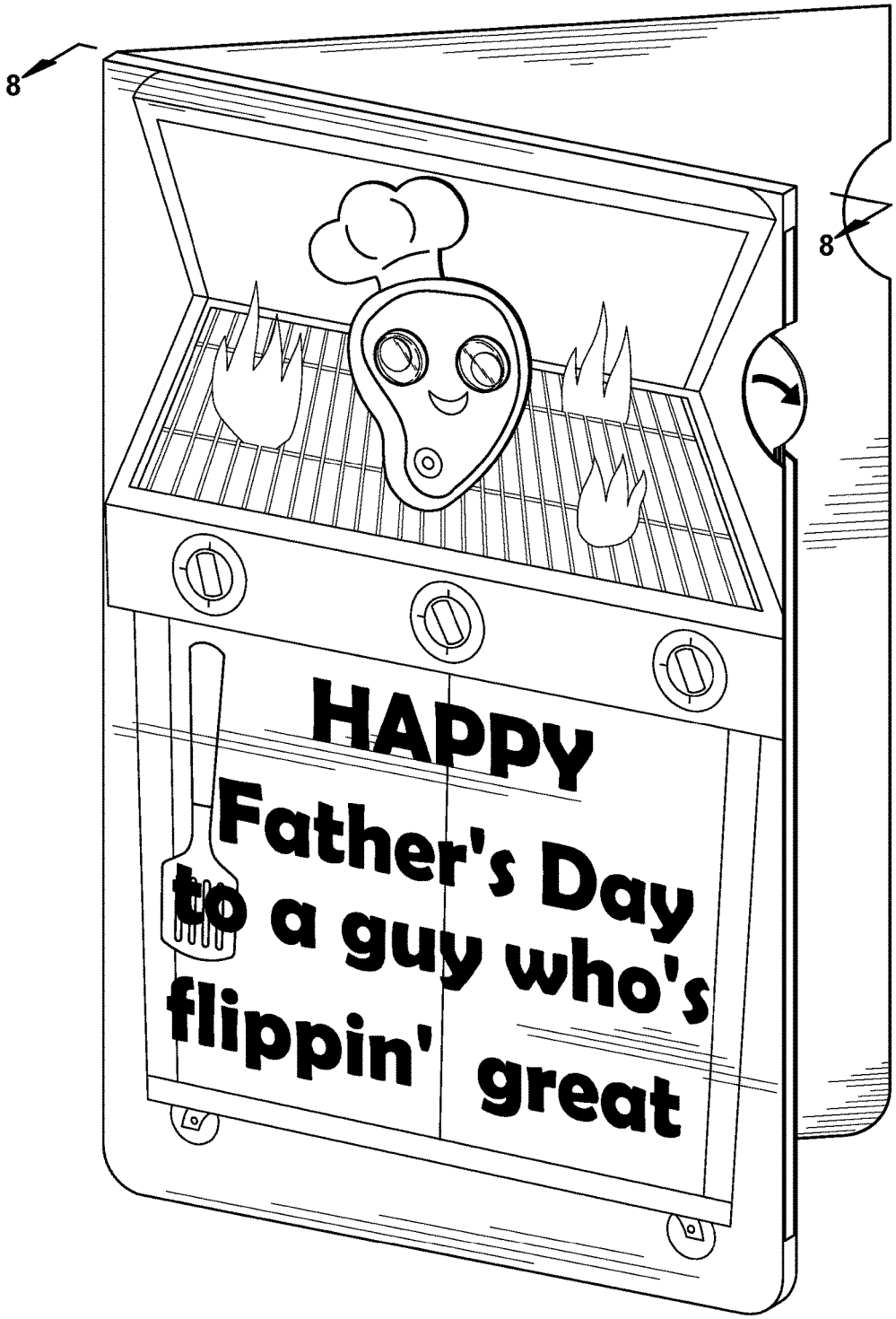
FIG. 6 is a perspective view of a second embodiment of the greeting card of the present invention.
Figure 7:
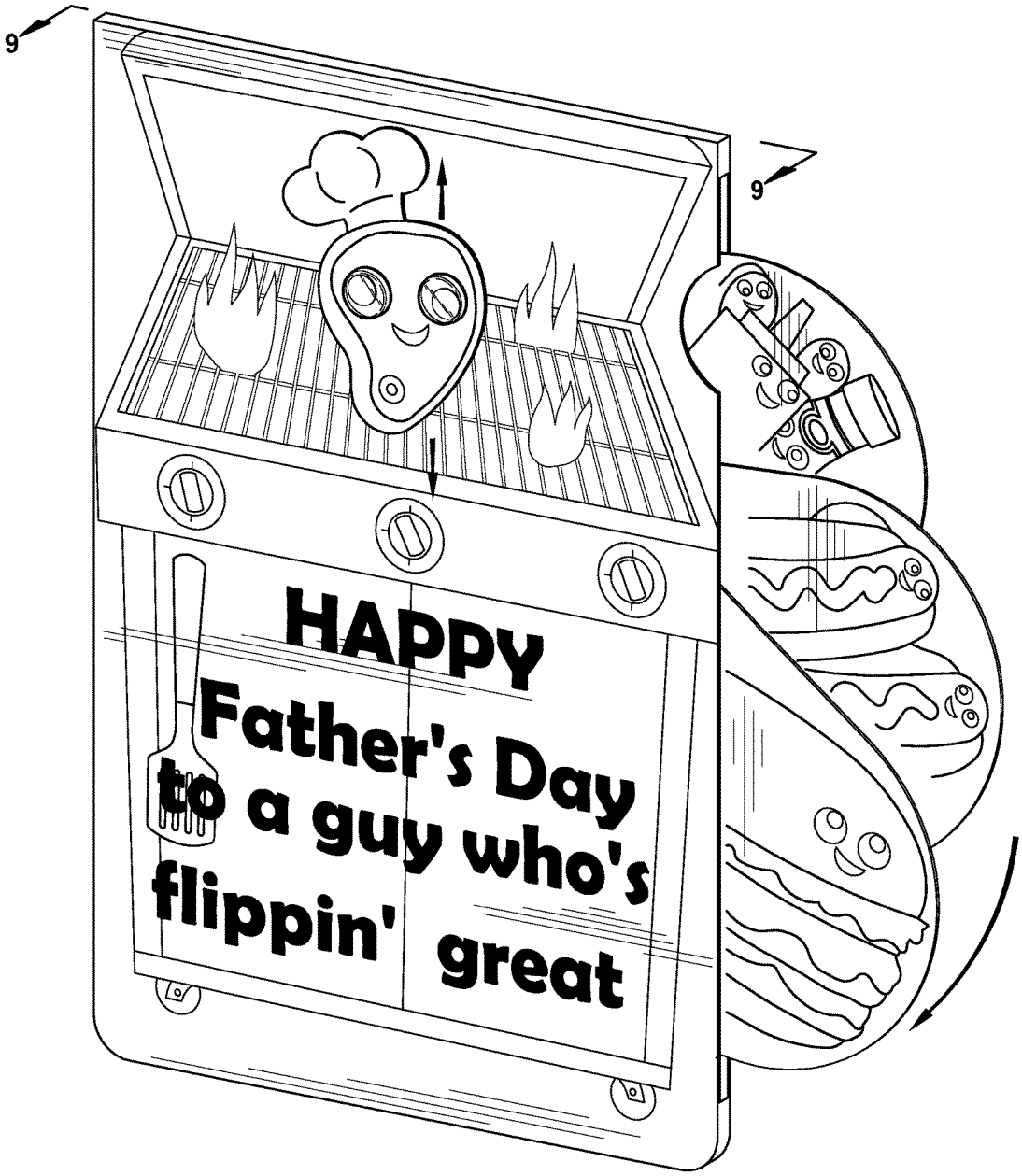
FIG. 7 is a perspective view of the greeting card of FIG. 6, with open pull out structure
Figure 8:
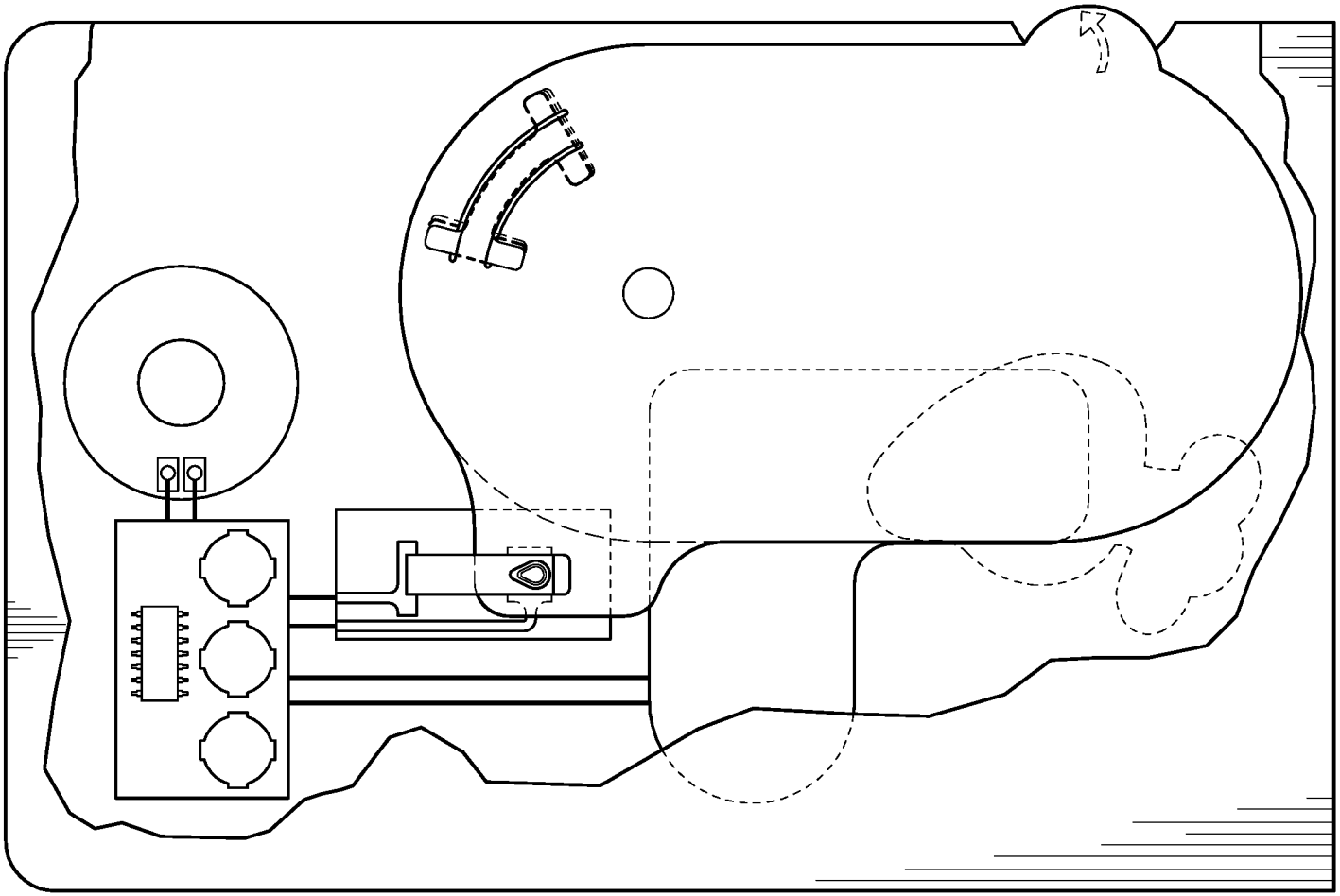
FIG. 8 is a front tear-away view of the greeting card of FIG. 6, from the perspective or arrows 8-8.
Figure 9:
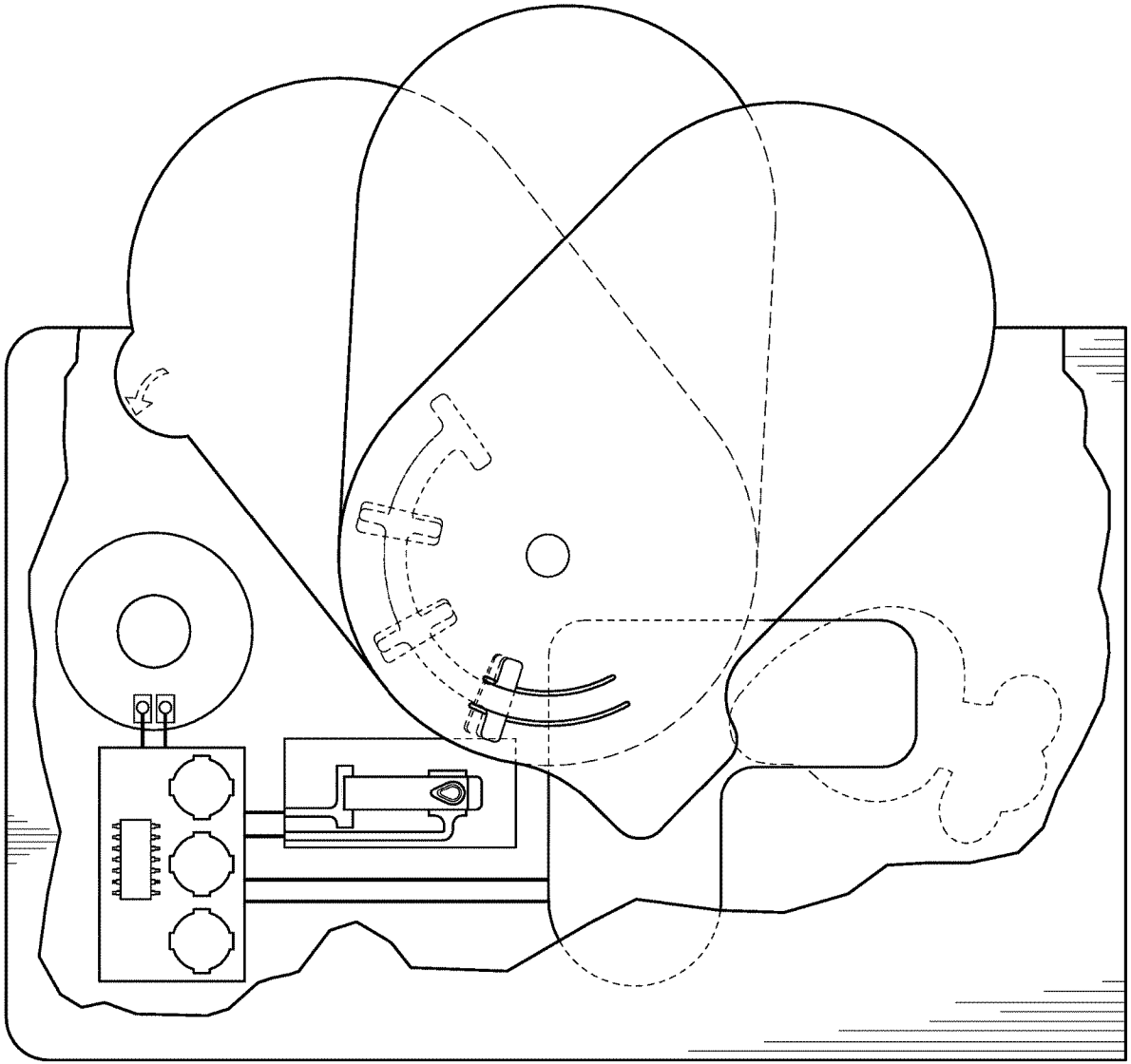
FIG. 9 is a front tear-away view of the greeting card of FIG. 7, from the perspective of arrows 9-9.
Figure 10:
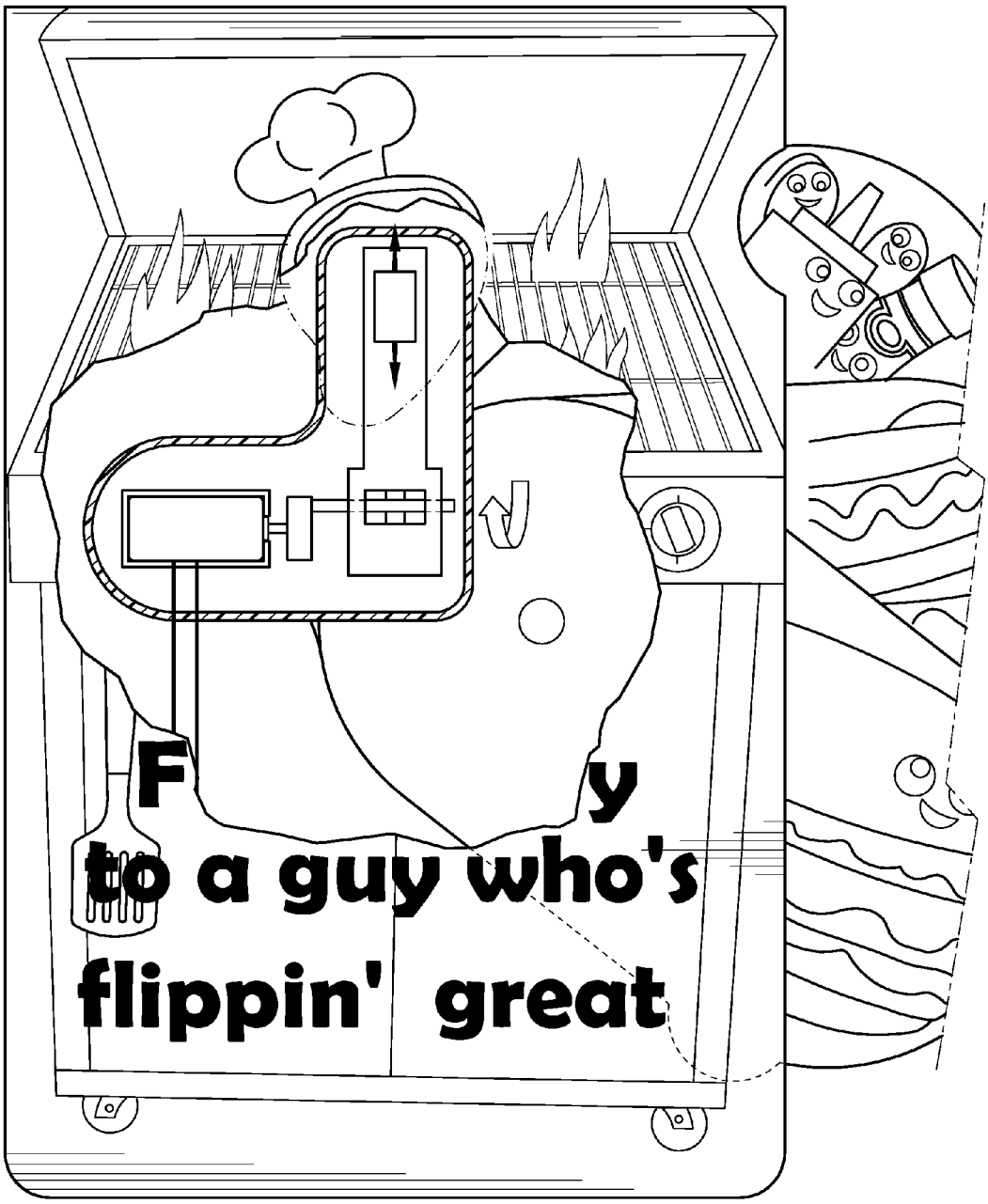
FIG. 10 is a front partial tear-away view of the greeting card of FIG. 7, showing the motor.

A multi-panel insert MPI is contained within the cavity between the first P1 and second P2 greeting card panels. This insert MPI is described above with respect to the first embodiment, including the method by which the various panels of the multi-panel insert MPI are attached and the way in which they move with respect to one another (including the two arced slots 16A, 16B on each panel and the stopper mechanisms 18). As described above, the multi-panel insert MPI is operative to move from a first position, wherein it is substantially contained within the greeting card 200 (as shown in FIGS. 6 and 8) to a second position, wherein it is substantially contained outside of the greeting card 200 (as shown in FIGS. 7 and 9). However, in this embodiment, instead of having the insert MPI unfold over a top surface of the greeting card 200, this insert is unfurled along the right side of the greeting card 200, as shown in FIG. 7. Alternatively, the multi-panel insert MPI may be located at various locations within the greeting card 200 and may be accessed through openings along the left side, top, bottom or right side of the greeting card 200 or a combination thereof. Various locations have been contemplated and are considered to be within the scope of the present invention. In a preferred embodiment, this embodiment contains three MPI1, MPI2, MPI3 multi-panel insert MPI panels. As described above, a small pull tab mechanism 30 is integral with or attached to the upper most panel MPI1 in the multi-panel insert MPI stack. The pull tab mechanism 30 peeks out from the opening in the right side edge of the greeting card 200 between the first P1 and second panels P2, as shown in FIG. 6. It may contain printing thereon instructing the user to "slide" or "pull" to unfurl the fan-like construct (aka MPI). A user may use the pull tab 30, such as by grasping the pull tab 30 between a thumb and index finger and sliding the from an upper region of the right side edge of the greeting card 200 to a lower region of the right side edges of the greeting card 200. Unlike the first embodiment described above, instead of each panel MPI1, MPI2, MPI3 f the multi-panel insert MPI representing a portion of a wig or of the hair of a character or animal, each panel MPI1, MPI2, MPI3 in this embodiment represents items or objects related to the theme of the greeting card 200. For example, as shown in FIGS. 5 through 10, a Father's Day greeting card may contain a barbeque theme, in which case, the panels MPI1, MPI2, MPI3 of the multi-panel insert MPI may represent various barbeque items such as a hotdog, a hamburger, ketchup, mustard, etc. In another example, a Father's Day greeting card may contain a golf theme, in which case, the panels in the multi-panel insert may represent a golf club, golf shoes, golf flags, etc. The shapes of the individual panels MPI1, MPI2, MPI3 may be the same, similar or different.

As described above with respect to the first embodiment, some of the internal electronic components of this greeting card may include, but are not limited to: a circuit board 22; an integrated circuit chip; a power source 24; a memory device; a speaker 26; a motor 32; a switch 34 and at least one pre-recorded digital audio clip. The electronic components of the greeting cards described herein are considered to be readily understood and appreciated by one of ordinary skill in the art and are therefore not discussed in detail herein. In addition to audio capabilities, the greeting may contain additional electronic features such as one or more lights or other special effects.

At least a portion of at least one of the panels MPI1, MPI2, MPI3 in the multi panel insert MPI is inserted between the arms of a contact switch 34. The contact switch 34 is operative to control activation of a sound module and a motor 32. The sound module is operative to store and playback at least one audio file. The motor 32 is operative to cause movement of a mobile object 36 attached to the greeting card 200. When the two arms of a contact switch 24 are in contact, the electric circuit is completed and separating the arms, such as by the insertion of at least a portion of one of the panels MPI1, MPI2, MPI3 of the multi-panel insert MPI, breaks the circuit. Therefore, when the user begins to unfold the multi-panel insert MPI by pulling the tab 30 in a downward direction, the panels MPI1, MPI2, MPI3 are removed from between the arms of the contact switch 34, causing the two arms to connect and complete the circuit, which thereby causes audio to be replayed through a speaker 26 and also causes movement of the mobile object 36 via the motor module 32. The mobile object 36, in a preferred embodiment, is a die cut shape having googly eyes 38, or other small decorative embellishments attached thereto. Googly eyes 38 are clear, hard, closed plastic shells with smaller black disk trapped therein which is free to move about. The die cut shape may represent an item or object which is complementary to the theme of the greeting card 200. For example, in the barbeque-themed greeting card described above and shown in the figures, the moving object 38 may represent a steak having a face or other animated features thereon. In another embodiment, a Father's Day greeting card may contain a golf theme, in which case, mobile object 38 may represent a golf club, or other golf-themed item which may have a face or other animated features thereon. In a preferred embodiment, the mobile object 38 is attached to the front cover P1 of the greeting card 200. It is attached to the motor 32 either directly or through a connection arm. The motor 32 may be of the type having a rotating arm or shaft which creates oscillatory motion upon rotation of the shaft by the motor or the motor 32 may have a rotating gear mechanism that turns a circular gear. Alternatively, the motor 32 may be of any type which is small enough to fit into a greeting card and able to effect movement of a mobile object. The motor 32 may be operative to effect back-and-forth, up-and-down (or bouncing), vibrating, or other such movement of the mobile object 38. Folding the multi-panel insert MPI back into the greeting card 200 by reversing the downward motion used to unfold the insert MPI, will re-insert at least a portion of at least one of the panels MPI1, MPI2, MPI3 of the multi-panel insert MPI between the two arms of the contact switch 34, thereby breaking the circuit and deactivating the sound and motor 32 modules. The sound and motor modules may be operative, once activated, to remain activated for a pre-set period of time such as ten seconds, fifteen seconds, twenty seconds, or greater than twenty seconds before deactivating (if not manually deactivated by re-inserting at least a portion of at least one of the panels MPI1, MPI2, MPI3 of the multi-panel insert MPI between the two arms of the contact switch 34).

While the embodiments of the greeting card of the present invention have been described above and shown in the figures to have a particular size, shape, number of panels, etc., other sizes, shapes and number of panels have been contemplated and are considered to be within the scope of the present invention. The position of the multi-panel insert is optional and does not need to be positioned exactly as described above with respect to the two embodiments. The number of panels contained as part of the multi-panel insert may be varied as well, such as two, three, four, five and so on. The switches described here can be interchanged with various other types of switches known to one having skill in the art, such as push button switches, sound activated switches, touch sensitive switches, light sensitive switches, motion switches, slide switches, etc. Also, the material mentioned herein is paper, however any other lightweight material may be used in place of paper. The mobile object of the second embodiment may also be a lightweight object instead of a die cut shape. The embodiments described herein are intended to provide an example of the preferred embodiments and are not meant to limit the invention in any way.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. An interactive greeting card comprising:

a multi-panel greeting card body having at least one cavity contained therein;

a multi-panel insert comprising a plurality of individual panels attached at a pivot point, at least one of the plurality of individual panels having a pull tab attached thereto;

the multi-panel insert being capable of moving from a first position wherein the plurality of individual panels are contained within the at least one cavity in the multi-panel greeting card body and a second position wherein each of the plurality of individual panels are fanned out outside the greeting card;

at least one panel of each pair of successive panels in the multi-panel insert having a pair of parallel arced slots thereon;

a stopper mechanism attached between each pair of successive panels in the multi-panel insert, the stopper mechanism operative to restrict the independent movement of at least one panel in each pair of successive panels.

2. The interactive greeting card of claim 1 further comprising a sound module operative to store and replay audio upon movement of the multi-panel insert from the first position to the second position.

3. The interactive greeting card of claim 1 further comprising a sound module operative to store and replay audio upon movement of at least one of the plurality of individual panels in the multi-panel insert.

4. The interactive greeting card of claim 1 further comprising a mobile object attached to the greeting card and a motor contained within the at least one cavity contained in the multi-panel greeting card body, the motor operative to cause movement of the mobile object.

5. The interactive greeting card of claim 4, wherein the motor is activated upon movement of the multi-panel insert from the first position to the second position.

6. The interactive greeting card of claim 4, wherein the motor is activated upon movement of the at least one of the plurality of individual panels in the multi-panel insert.

7. The interactive greeting card of claim 1, wherein the multi-panel insert is unfurled across a top edge of the greeting card when it is in the second position.

8. The interactive greeting card of claim 1, wherein the multi-panel insert is unfurled along a side edge of the greeting card when it is in the second position.

9. An interactive greeting card comprising:

a multi-panel greeting card body;

a multi-panel insert contained within the multi-panel greeting card body, the multi-panel insert operative to be fanned out in series along an arced path over an outer edge of the multi-panel greeting card body;

a sound module operative to store and replay at least one audio file upon moving at least one of the at least two panels of the multi-panel insert.

10. The interactive greeting card of claim 9 further comprising a mobile object and a motor module which is operative to cause movement of the mobile object.

11. The interactive greeting card of claim 10, wherein the mobile object is located on a front cover of the greeting card.

12. The interactive greeting card of claim 9, wherein each of the at least two panels of the multi-panel insert are attached to one another.

13. The interactive greeting card of claim 9, wherein each of the at least two panels of the multi-panel insert are able to at least partially move about a pivot point.

14. The interactive greeting card of claim 9, wherein the multi-panel insert is fanned out along a top edge of the greeting card.

15. The interactive greeting card of claim 9, wherein the multi-panel insert is fanned out along a side edge of the greeting card.

16. An interactive greeting card comprising:

a greeting card body;

a fan-like object contained within the greeting card body, the fan-like object comprising a plurality of separate but attached panels configured in a stacked arrangement;

at least one panel of each pair of successive panels in the fan-like object having a pair of parallel arced slots thereon;

a stopper mechanism attached between each pair of successive panels in the fan-like object, the stopper mechanism operative to restrict the independent movement of at least one panel in each pair of successive panels;

wherein a first of the plurality of panels in the fan-like object is operative to be pulled out from within the greeting card body by a user and each successive panel is pulled out from within the greeting card body by attachment to a panel located above said panel via the stopper mechanism.

17. The interactive greeting card of claim 16 further comprising a sound module operative to store and playback at least one audio file.

18. The interactive greeting card of claim 17, wherein movement of at least one of the plurality of separate but attached panels of the fan-like object initiates the sound module to play the at least one audio file.

19. The interactive greeting card of claim 16 further comprising a mobile object and a motor module operative to effect movement of the mobile object.

20. The interactive greeting card of claim 19, wherein movement of at least one of the plurality of separate but attached panels of the fan-like object initiates the motor module to effect movement of the mobile object.

* * * * *